US005460002A

United States Patent [19]

Correa

[11] Patent Number: 5,460,002

[45] Date of Patent: Oct. 24, 1995

[54] CATALYTICALLY-AND AERODYNAMICALLY-ASSISTED LINER FOR GAS TURBINE COMBUSTORS

[75] Inventor: Sanjay M. Correa, Schenectady, N.Y.

[73] Assignee: General Electric Company, Schenectady, N.Y.

[21] Appl. No.: 250,633

[22] Filed: May 27, 1994

Related U.S. Application Data

[63] Continuation of Ser. No. 64,467, May 21, 1993, abandoned.

[51] Int. Cl.[6] ..... F23R 3/40

[52] U.S. Cl. ..... 60/723; 60/753

[58] Field of Search ..... 60/39.06, 723, 60/752, 753, 755; 126/19 R; 431/7, 158, 353

[56] References Cited

U.S. PATENT DOCUMENTS

| | | | |
|---|---|---|---|
| 2,489,244 | 11/1949 | Stalego | 431/158 |
| 3,738,350 | 6/1973 | Stiles | 126/19 R |
| 3,927,520 | 12/1975 | Arvin et al. | 60/39.23 |
| 4,425,136 | 1/1984 | Pearson et al. | 44/51 |
| 4,603,547 | 8/1986 | Pfefferle et al. | 60/723 |
| 4,926,645 | 5/1990 | Iwai et al. | 60/723 |
| 5,181,379 | 1/1993 | Wakeman et al. | 60/753 |
| 5,226,278 | 7/1993 | Meylan et al. | 60/752 |

*Primary Examiner*—Timothy S. Thorpe

*Attorney, Agent, or Firm*—Patrick R. Scanlon; Paul R. Webb, II

[57] ABSTRACT

Carbon monoxide and unburned hydrocarbon burnout in gas turbine combustors is promoted by a combustor liner having a plurality of vortex generating members or ridges formed therein. The liner includes a substrate having an inner surface and a thermal barrier coating disposed on the inner surface. The vortex generating ridges are formed in the thermal barrier coating and extend transverse to the mean direction of flow through the liner. The thermal barrier coating is capped with a catalytic material which enhances carbon monoxide and unburned hydrocarbon oxidation. The ridges are defined by raised portions of the catalytic material and are of sufficient height to cause mixing between the hot flame products and the cool incompletely-burned flow along the liner wall. Alternatively, the ridges can be defined by forming corrugations in the substrate and disposing a uniform catalytically-active thermal barrier coating over the corrugated substrate.

4 Claims, 1 Drawing Sheet

CATALYTICALLY-AND AERODYNAMICALLY-ASSISTED LINER FOR GAS TURBINE COMBUSTORS

This application is a Continuation of application Ser. No. 08/064,467, filed May 21, 1993, now abandoned.

BACKGROUND OF THE INVENTION

This invention relates generally to gas turbine combustors and more particularly concerns combustion liners having a catalytically active thermal barrier coating with vortex generating ridges formed on the inner surface thereof.

Traditional gas turbine combustors use diffusion (i.e., nonpremixed) flames in which fuel and air enter the combustion chamber separately. The process of mixing and burning produces flame temperatures exceeding 3900° F. Since the maximum temperature conventional combustor liners are generally capable of withstanding is on the order of about 1500° F. steps to protect the liners must be taken. This is typically done by film-cooling which involves introducing the relatively cool compressor air into a plenum surrounding the outside of the liner. The air from the plenum passes through louvers in the liner and then passes as a film over the inner surface of the liner, thereby maintaining liner integrity.

Because diatomic nitrogen rapidly disassociates at temperatures exceeding about 3000° F., the high temperatures of diffusion combustion result in relatively large $NO_x$ emissions. One approach to reducing $NO_x$ emissions is to premix the maximum possible amount of compressor air with fuel. The resulting lean premixed combustion produces cooler flame temperatures and thus lower $NO_x$ emissions. Although lean premixed combustion is cooler than diffusion combustion, the flame temperature is still too hot for conventional liners to withstand. Furthermore, because the advanced combustors premix the maximum possible amount of air with the fuel for $NO_x$ reduction little or no cooling air is available making film-cooling of the liner impossible. Thus, a thermal barrier coating in conjunction with "backside" cooling have been considered to protect the liner. Backside cooling involves passing the compressor air over the outer surface of the liner prior to premixing the air with the fuel.

Lean premixed combustion reduces $NO_x$ emissions by producing lower flame temperatures. However, the lower temperatures, particularly along the inner surface or wall of the liner, tend to quench oxidation of carbon monoxide and unburned hydrocarbons and lead to unacceptable emissions of these species. To oxidize carbon monoxide and unburned hydrocarbons, a liner would require a thermal barrier coating of extreme thickness (50–100 mils) so that the surface temperature could be high enough to ensure complete burnout of carbon monoxide and unburned hydrocarbons. This would be approximately 1800°–20000° F. for combustors of typical lengths and flow conditions. However, such thicknesses and temperatures are beyond materials capabilities. Thermal barrier coatings degrade in unacceptably short times at these temperatures and such thick coatings are susceptible to spallation.

Accordingly, there is a need for a combustion liner which can withstand combustion temperatures without film-cooling and yet maintain flame stability and burn out carbon monoxide and unburned hydrocarbons.

SUMMARY OF THE INVENTION

The above-mentioned needs are met by the present invention which provides a liner for gas turbine combustors. The liner includes a substrate having an inner surface and a thermal barrier coating disposed on the inner surface. A plurality of vortex generating members or ridges are formed in the thermal barrier coating on the inner surface of the substrate. The vortex generating ridges extend transverse to the mean direction of flow through the liner and can extend completely around the inner surface. The thermal barrier coating includes a catalytic material for carbon monoxide and unburned hydrocarbon oxidation. The ridges are defined by raised portions of the catalytic material and are of sufficient height to shed vortices, thereby promoting mixing between the hot flame products and the cool incompletely-burned flow along the wall. The ridge height will thus have to scale with the boundary layer thickness parameters. Alternatively, the ridges can be defined by forming corrugations in the substrate and disposing a uniform catalytically-active thermal barrier coating over the corrugated substrate.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
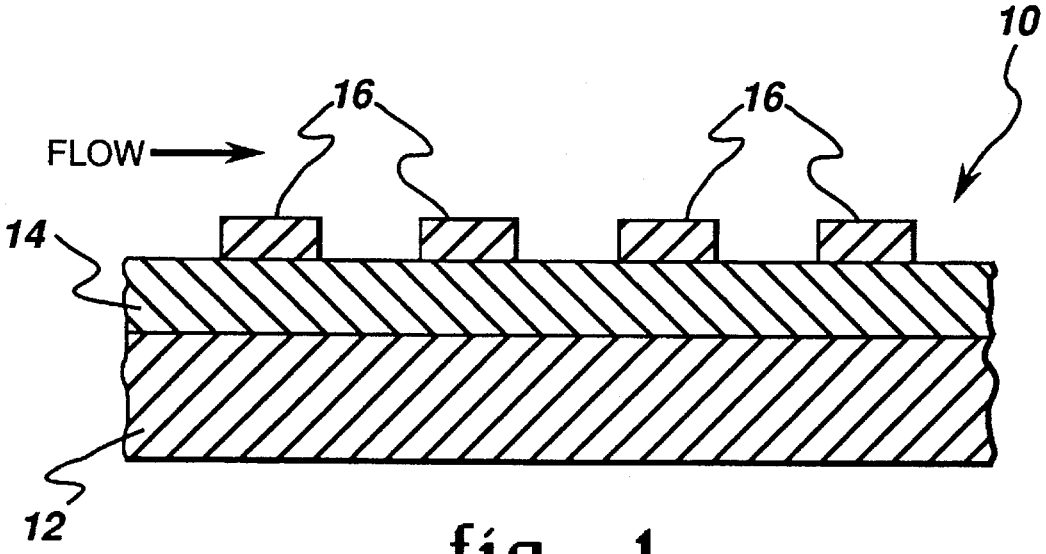
FIG. 1 is a cross-sectional side view of a portion of a combustion liner which is a first embodiment of the present invention.

Referring to the drawings wherein identical reference numerals denote the same elements throughout the various views, FIG. 1 shows a cross-sectional side view of a portion of a combustion liner 10 of the present invention. The liner 10 comprises a substrate 12 formed of a metal, such as nickel-based alloys, which is generally resistant to heat and corrosion. The substrate 12 has an inner surface which is exposed to the hot flow of the combustion process and is thus called the hot side. A thermal barrier coating 14 is coextensively formed on the hot side of the substrate 12 to protect the substrate from the heat of combustion. Generally, the thermal barrier coating 14 is approximately 20–25 mils thick. The thermal barrier coating 14 preferably comprises a base material for providing thermal protection capped with a catalytic material for promoting oxidation of carbon monoxide and unburned hydrocarbons. Any catalytic material suitable for carbon monoxide and unburned hydrocarbon oxidation can be used; chromates are one preferred class of such materials. Yttria-stabilized zirconia is a suitable base material for the thermal barrier coating 14.

As seen in FIG. 1 a plurality of vortex generating members 16 are formed on the thermal barrier coating 14. The vortex generating members 16 are a series of ridges extending transverse to the direction of mean flow through the combustor liner 10. The ridges 16 may extend completely around the entire inner or hot side surface defined by the substrate 12. The direction of mean flow is essentially parallel to the longitudinal axis of the combustor liner 10.

The ridges 16 cause unsteady shedding and generate spanwise vortices. This unsteady flow mixes the cool incompletely-burned flow along the liner wall with the hot flame products which promotes burnout of carbon monoxide and unburned hydrocarbons. The burnout is also assisted by the catalyst in the thermal barrier coating 14.

The ridges 16 are defined by raised portions of the catalytic material formed on the hot side surface of the thermal barrier coating 14. The optimal spacing and height of the ridges 16 will be dependent on the particular characteristics of each individual combustor. However, to be effective, the ridges 16 will need to be of sufficient height to ensure adequate mixing between the hot flame products and the cool, incompletely-burned flow along the liner wall. Thus, the height of the ridges 16 will have to scale with the boundary layer thickness parameters. That is, the ridge height should be on the same order of magnitude as the boundary layer thickness, although not necessarily greater than the boundary layer thickness. Generally, the height of the ridges 16 should be no less than one-tenth of the boundary layer thickness.

The catalytically-active thermal barrier coating 14 with raised ridges 16 may be formed using a modification of the plasma spray process currently used in forming conventional thermal barrier coatings. Such a process would employ the usual first feed containing the thermal barrier material and add a second feed containing the catalytic material. By gradually switching from the first feed to the second feed, a continuous gradation of properties will be achieved. The formation of the ridges is accomplished by traversing the sprayer over the substrate 12 for longer times for the portions where the ridges are desired. Alternative fabrication techniques, such as painting in slurry form, can also be used.

Figure 2:
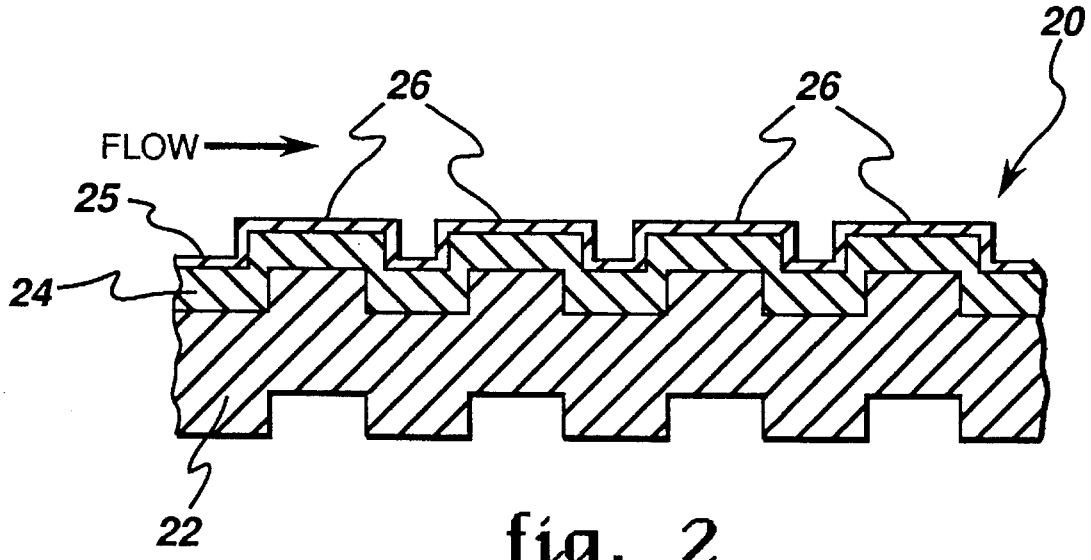
FIG. 2 is a cross-sectional side view of a portion of a combustion liner which is a second embodiment of the present invention.

FIG. 2 shows a second embodiment of the present invention which is particularly useful when the required height of the ridges is too large for the coating of the FIG. 1 embodiment to reliably adhere to the substrate. In FIG. 2, a combustor liner 20 comprises a corrugated substrate 22 having an inner surface which is exposed to the hot flow of the combustion process. The corrugations in the substrate 22 are transverse to the longitudinal axis of the substrate 22 (so as to be transverse to the mean flow through the liner 20) and may extend completely around the substrate 22. A thermal barrier coating 24 is coextensively formed on the inner surface of the substrate 22 to protect the substrate from the high combustion temperatures. The thermal barrier coating 24 is capped with a catalyst 25 for promoting oxidation of carbon monoxide and unburned hydrocarbons.

Due to the corrugations in the metal substrate 22, the liner 20 is provided with a plurality of vortex generating members or ridges 26 which promote burnout of carbon monoxide and unburned hydrocarbons. The burnout is assisted by the catalyst 25 in the thermal barrier coating 24. As with the first embodiment, the ridges 26 will need to be of sufficient height to ensure adequate mixing between the hot flame products and the cool, incompletely-burned flow along the liner wall. The ridge height should be on the same order of magnitude as the boundary layer thickness, although not necessarily greater than the boundary layer thickness.

The foregoing has described a combustor liner useful with lean premixed combustors which is capable of withstanding combustion temperatures without film-cooling and burning out carbon monoxide and unburned hydrocarbons. While specific embodiments of the present invention have been described, it will be apparent to those skilled in the art that various modifications thereto can be made without departing from the spirit and scope of the invention as defined in the appended claims.

What is claimed is:

1. A gas turbine apparatus comprising:

a combustor liner having a non-corrugated inner surface;

a thermal barrier coating disposed on said inner surface; and a plurality of ridges disposed on top of said thermal barrier coating transverse to the mean direction of flow through said combustor liner, each one of said plurality of said ridges consisting of a catalytic material which promotes carbon monoxide and unburned hydrocarbon oxidation.

2. The gas turbine apparatus of claim 1 wherein said ridges completely extend around said inner surface of said liner.

3. The gas turbine apparatus of claim 1 wherein the height of each one of said plurality of said ridges is at least one-tenth of the boundary layer thickness.

4. The gas turbine apparatus of claim 1 wherein said thermal barrier coating is 20–25 mils thick.

* * * * *